US008234983B2

(12) United States Patent
Randolph

(10) Patent No.: US 8,234,983 B2
(45) Date of Patent: Aug. 7, 2012

(54) POST AND BEAM FURNITURE CONSTRUCTION

(76) Inventor: Travis M Randolph, Saugatuck, MI (US)

( * ) Notice: Subject to any disclaimer, the term of this patent is extended or adjusted under 35 U.S.C. 154(b) by 0 days.

(21) Appl. No.: 12/978,000

(22) Filed: Dec. 23, 2010

(65) Prior Publication Data

US 2011/0155679 A1 Jun. 30, 2011

Related U.S. Application Data

(63) Continuation-in-part of application No. 11/620,420, filed on Jan. 5, 2007, now abandoned.

(60) Provisional application No. 60/756,725, filed on Jan. 6, 2006.

(51) Int. Cl.
*A47B 9/00* (2006.01)

(52) U.S. Cl. ..... 108/108; 108/147.17; 248/235; 248/241; 248/243

(58) Field of Classification Search ..... 312/223.3, 312/196; 108/50.01; 211/192; 52/36.4–36.6, 52/238.1, 220.7, 481.2, 653.7, 653.2, 654.1; 248/222.41, 223.21, 225.11, 235, 241, 243, 248/250

See application file for complete search history.

(56) References Cited

U.S. PATENT DOCUMENTS

| | | | | | |
|---|---|---|---|---|---|
| 977,609 | A | * | 12/1910 | Freeman | 248/243 |
| 2,827,254 | A | | 3/1958 | Faber | |
| 2,990,067 | A | * | 6/1961 | Bartlett | 108/147.15 |
| 3,182,945 | A | * | 5/1965 | Sedo | 248/242 |
| 3,601,432 | A | * | 8/1971 | Fenwick et al. | 403/230 |
| 4,378,925 | A | * | 4/1983 | Griffin | 248/242 |
| 4,531,698 | A | * | 7/1985 | Sharber | 248/243 |
| 5,025,937 | A | | 6/1991 | King | |
| 5,063,715 | A | * | 11/1991 | Goodman | 52/36.6 |
| 5,205,421 | A | * | 4/1993 | Bustos | 211/59.2 |
| 5,592,886 | A | | 1/1997 | Williams et al. | |
| 5,624,045 | A | | 4/1997 | Highsmith et al. | |
| 5,664,380 | A | | 9/1997 | Hsueh | |
| 5,845,795 | A | | 12/1998 | Mulholland | |
| 5,899,035 | A | | 5/1999 | Waalkes et al. | |
| 6,041,720 | A | | 3/2000 | Hardy | |
| 6,557,310 | B2 | | 5/2003 | Marshall et al. | |
| 6,751,914 | B2 | | 6/2004 | Zeh et al. | |
| 6,773,080 | B2 | * | 8/2004 | Chen et al. | 312/265.1 |
| 6,817,688 | B2 | * | 11/2004 | O'Halloran | 312/404 |
| 6,851,653 | B2 | | 2/2005 | Crowley et al. | |
| 6,948,691 | B2 | | 9/2005 | Brock et al. | |
| 7,311,211 | B2 | | 12/2007 | Chung | |
| 7,641,297 | B2 | * | 1/2010 | Huang | 312/334.4 |
| 2002/0029529 | A1 | | 3/2002 | Waalkes et al. | |
| 2005/0156493 | A1 | * | 7/2005 | Yang et al. | 312/334.5 |
| 2007/0062898 | A1 | | 3/2007 | Choi | |

FOREIGN PATENT DOCUMENTS

WO 2004089159 10/2004

* cited by examiner

*Primary Examiner* — Darnell Jayne
*Assistant Examiner* — Andres F Gallego
(74) *Attorney, Agent, or Firm* — John A. Waters; Donald J. Wallace; Waters & Associates PLC

(57) ABSTRACT

A post and beam furniture construction has a number of support posts and a plurality of beams that interconnect the posts. Accessories, including storage shelves and cabinets, and work surfaces are releasably supported by the posts at various positions relative to the shelf length and the post spacing. Support brackets interconnect accessories and posts. Each post has at least two accessory support rails extending along the post length. A support bracket engages a selected rail. Spaced support bracket receptacles extend along a length of the accessory and a support bracket engages a selected bracket receptacle. The beams may be removed from respective posts without moving the posts and may also be length adjustable.

12 Claims, 11 Drawing Sheets

POST AND BEAM FURNITURE CONSTRUCTION

CROSS-REFERENCE TO RELATED APPLICATIONS

This application is a continuation-in-part of Applicant's co-pending application Ser. No. 11/620,420, entitled Post and Beam Furniture Construction, filed Jan. 5, 2007, which in turn is a non-provisional application based on Applicant's now expired provisional Application No. 60/756,725 of the same title, filed Jan. 6, 2006, the disclosures of which are incorporated herein by reference.

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO A SEQUENCE LISTING

Not Applicable.

BACKGROUND OF THE INVENTION

The invention relates to post and beam furniture construction and more particularly to accessory positioning relative to post spacing and to accessory length and beam installation and removal without post movement.

Many modular work environment partition systems available in the marketplace offer many clever options for workplace landscape design, productivity enhancement, and the like. In using workplace panel systems, however, basic geometric or physical phenomena must be accommodated. One such occurrence has been referred to as "creep" and is basically a result of non-linear panel intersection such as making corners with panels. Intersecting panels at corners is common when a large room is partitioned into desired work areas or stations and is required by structural considerations.

Panels are three dimensional elements, having height, width, and thickness. As panels are joined edge to edge, a straight wall may be formed. The length of the formed wall is a result of the width of the panels times the number of panels used. Work enhancing accessories, including such items as various work surfaces, storage accessories, and lighting accessories, for example, are typically hung upon and supported by the partition system panels. A work surface accessory may further be any of a variety of surfaces, including bench, table, or desk surfaces. A storage accessory may include any of a number of storage accessories, including a shelf or a cabinet or the like. These accessories are typically provided in modular widths that correspond to the modular width of the partition wall panels.

When the distance of a panel thickness is added into or effectively removed from the length of a partition wall, however, shorter and longer width accessories are required to avoid arrangement conflicts. With reference to a schematic sketch of a prior art modular wall of FIG. 1, a series of wall panels "W" are interconnected to define work spaces and to support various accessory components "A." As shown, a cross wall thickness may encroach into an accessory space and make the space too small for an accessory in what may be a negative creep at "NC." Alternatively, the opposite situation of too much accessory space may occur with what may be a positive creep at "PC" and cause a gap between accessories, say a desk surface for example.

A common solution to these creeping partition wall issues is to provide accessories with differing widths, so a proper width accessory is available to accommodate various wall creep situations. This may increase the number of accessory items by as much as thirteen times, however, to provide accessories that are the same width as the panels, that are a panel thickness longer on the left end, that are a panel thickness longer on the right end, that are a panel thickness shorter on the left end, that are a panel thickness shorter on the right end, that are half a panel thickness longer on the left end, that are half a panel thickness longer on the right end, that are half a panel thickness shorter on the left end, that are half a panel thickness shorter on the right end, that are a panel thickness longer on both ends, that are a panel thickness shorter on both ends, that are half a panel thickness longer on both ends, and that are half a panel thickness shorter on both ends. This is clearly an onerous demand upon inventory and production.

Thus, one understands a desire for a workplace partitioning system that addresses the issue of creep, which is inherent in modular partition systems, and that addresses the associated inventory and production implications.

BRIEF SUMMARY OF THE INVENTION

Accordingly, a post and beam furniture construction of the invention provides an adjustable modular approach to workplace environment partition systems. The invention includes a number of support posts, a plurality of length adjustable beams, and various accessories that are adaptable regarding their relative position along a width of a panel.

In one aspect of the invention, an accessory support bracket connects with a post at a selected one of alternative accessory receptacles that are spaced along a width of a partition wall portion, thereby affecting the widthwise positioning of the bracket relative to the post. Further, an accessory may have a number of support bracket receptacles along a length of the accessory and the support bracket connects with a selected one of the bracket receptacles, thereby affecting the widthwise positioning of the accessory relative to the bracket.

In another aspect of the invention, a beam is connected between two adjacent support posts. The beam has an adjustable length. Further, a selected beam length defines a spacing between the adjacent posts. Further yet, the beam is adjustable in lengths that are a variety of incremental distances according to the spacing of both cooperating bracket receptacles that are disposed along the accessories and the spacing of accessory receptacles on supporting posts.

One more aspect of the invention is a beam that is connectable between and removable from between a pair of posts without repositioning the posts. A further aspect of the invention is that at least one of a panel or a screen is supported by at least one beam. Yet a further aspect of the invention is that a mount extends along a support post and an accessory or a beam connects with the post through the mount. The mount may further include a series of rungs disposed along the post length. A beam may have a jaw or cooperating upper and lower jaws that capture a rung, connecting the beam with the post.

These and other features or benefits of the invention will be recognized from this specification, including the claims and the drawing figures, by one having ordinary skill in the art and by those who practice the invention.

DETAILED DESCRIPTION OF THE INVENTION

Figure 2:
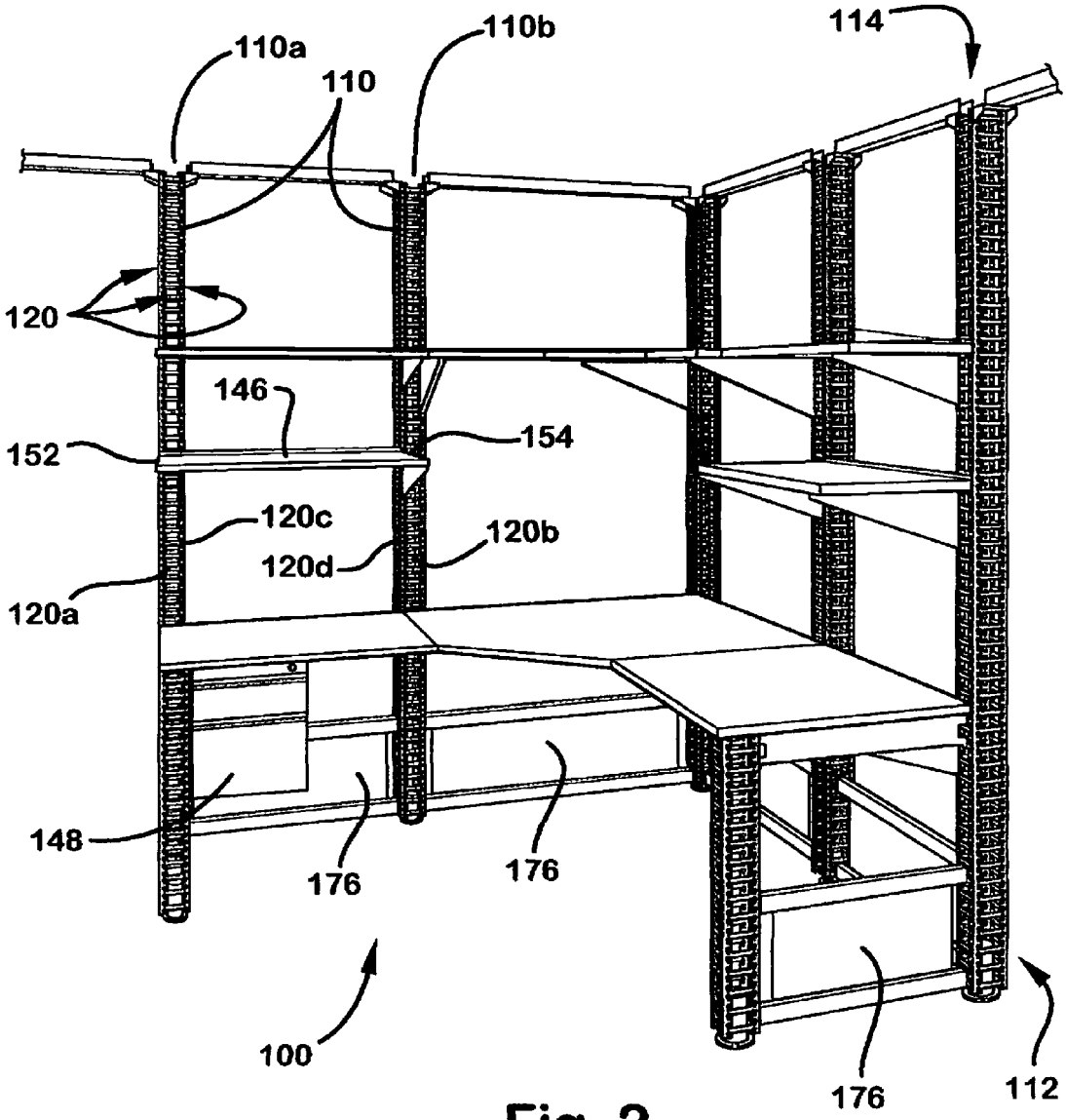
FIG. 2 is a perspective view of a first arrangement of a post and beam furniture construction of the invention, showing an L-shaped work station.
Figure 3:
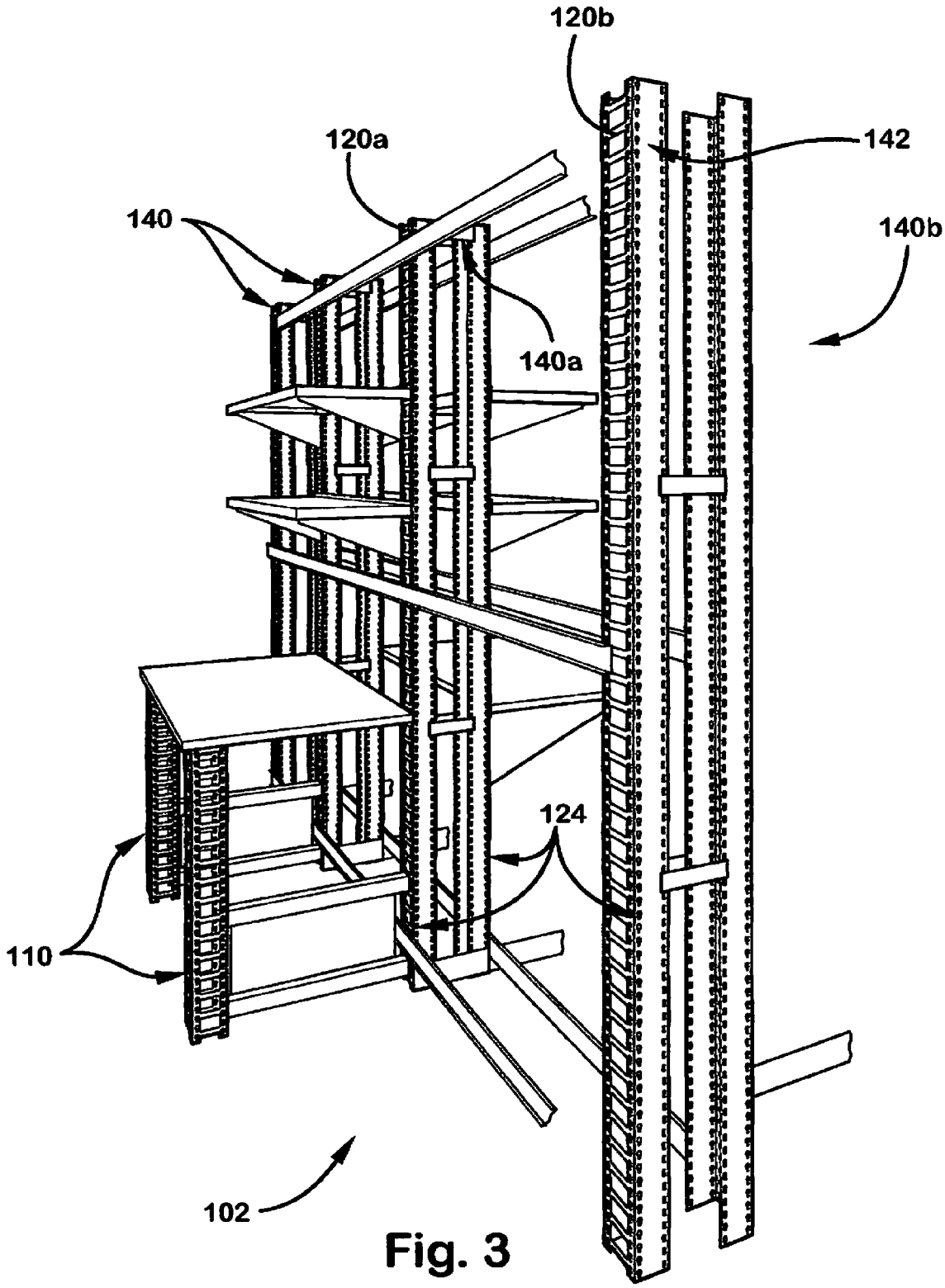
FIG. 3 is a perspective view of a second arrangement of a post and beam furniture construction of the invention, showing a double sided workstation wall.

With general reference to the drawing, a preferred embodiment of a post and beam furniture construction according to the invention is shown. More specifically, a free-standing L-shaped work station configuration 100 of the invention is shown in FIG. 2. Alternatively, a two-sided work station wall configuration 102 is shown in FIG. 3. These differing configurations generally indicate a flexibility of a post and beam furniture construction and expressly a post and beam furniture construction according to the invention.

In a simple concept, a post and beam furniture construction includes at least two posts 110 and a beam extending between the posts. The posts 110 are elongated structural members that extend generally upward from a floor end 112 to an opposite terminal end 114. Each post has a length from the floor end to the terminal end. The beam may preferably be an elongated structural member that extends from one post to another post, as discussed below, or alternatively may include a work enhancing accessory, which may as noted above, include such items as various work surfaces, storage accessories, and lighting accessories, for example. The invention further includes at least one mount 120 on each post and an accessory supported by the posts. Each mount extends at least partially along the length of its respective post and is a device by which a post is connected with other components of the construction system.

The posts in FIG. 2 are shown with four mounts extending along a length of each post, the entire length as shown. Selecting a post 110A and a post 110B, a first mount 120A and a third mount 120C extend along the post 110A, while a second mount 120B and a fourth mount 120D extend along the post 110B. These posts are spaced apart, with the first and second mounts 120A and 120B, respectively, oriented generally coplanar and with the third and fourth mounts 120C and 120D, respectively, facing one another. The posts shown in FIG. 2 are configured with an about four inch (102 mm) square tubular cross section and formed from a mild steel having a thickness of about ⅛ inch (3 mm). The inventor has found this scale, or dimensioning, to work well in industrial and laboratory environments and the like.

One having ordinary skill in the art and those who practice the invention will appreciate that various other scales, or dimensions, for the components of the invention may be appropriate for other specific uses of the invention, even in industrial and laboratory environments. Specific dimensioning of the components of the invention for various applications is merely a matter of a desired strength or of strength analysis. Thus, one having ordinary skill in the art understands that further recitation of component dimensions or omission of such dimensions does not affect the one's ability to successfully make and use the invention.

Figure 11:
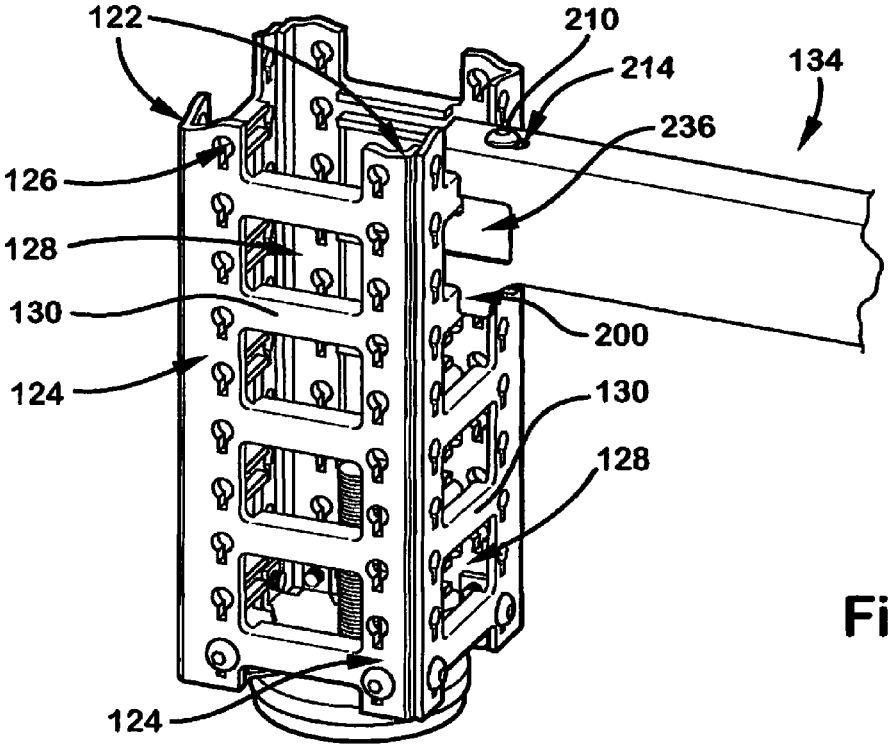
FIG. 11 is a fragmentary perspective view showing the jaw portion engaging a rung.

Each mount has two opposing edges 122 (FIG. 11) that extend along the post length with an accessory rail portion 124 extending along each opposing edge. An array of accessory receptacles 126 are defined along each rail. The accessory receptacles 126 specifically shown are defined by a series of known key-hole slots that have a circular portion, that have a leg or channel portion, and that cooperate with corresponding headed posts to hang accessories. This is not a limitation of the invention, however, and other releasable connections may be used with satisfactory result, including known hook and slot connections or a bolted connection, for example.

A plurality of openings 128 are also disposed along the post length and between the rails and open into the interior cavity that extends the length of the post. Each opening defines a rung portion 130 between the rails. The openings are also adapted to receive an end of a beam 134, as will be discussed further below.

With reference to FIG. 3, the posts 140 are shown with two mounts 120 extending along the length of each post and oriented on opposite post faces. Selecting a post 140A and a post 140B, a first mount 120A extends along the post 140A, while a second mount 120B extends along the post 140B. These posts are spaced apart, with the first and second mounts oriented generally coplanar. These first and second mounts share the same reference numbers with the first and second mounts of posts 110A and 110B in FIG. 2 because the first and the second mounts of each of the posts have the same structural configuration and are structurally equivalent.

It is further noted that while the posts 140A and 140B incorporate the same first and second mounts as do the posts 110A and 110B, the posts 140A and 140B do not incorporate the same third and fourth mounts. Rather, the first and second mounts of posts 140A and 140B are supplemented with an accessory rail 124 that extends along a length of an adjacent, orthogonal surface 142 of the respective post. The supplementing accessory rails 124 expand the versatility of the mounts 120 for supporting accessories. This supplementing accessory rail arrangement is noted in the posts of FIG. 2 by the presence of a mount 120 on an adjacent orthogonal surface.

An accessory is typically connected between and supported by mounts 120 of adjacent posts. An accessory may be one of a group of accessories, including such exemplary items as various work surfaces, storage accessories, and lighting accessories, for example. A work surface accessory may further be any of a variety of work surface accessories, including without limitation, bench, table, and desk surfaces. Further, a storage accessory may include any of a number of storage accessories, including a shelf, a cabinet, or the like, for example. With reference to FIG. 2, a storage accessory may at least include a shelf 146 and a cabinet 148. Although a lighting accessory is not specifically shown, it is anticipated to be structurally similar to the other accessories in its connection with the posts through the mounts 120. Each accessory will have a body portion that cooperates with mounting brackets as is more specifically described with regard to a shelf as follows.

A shelf 146 is connected with and supported by either posts 110A and 110B (FIG. 2) or posts 140A and 140B (FIG. 3), through the first 120A and the second 120B mounts, respectively, by way of brackets 150. The shelf, and each accessory by example of the shelf, has a first side 152 near the first mount and a second side 154 near the second mount. The shelf has a shelf length from the first side to the second side and is provided with an array of bracket receptacles 158 disposed along the length from the first side toward the second side. The shelf, or accessory, may also have an array of bracket receptacles disposed along the length from the second side toward the first side. In the embodiment shown in the drawing, the bracket receptacles are slots as are described further below.

Each support bracket as shown has a generally triangular design with a mounting edge 160 that will typically be generally vertically oriented and abut a mount 120 and with a support edge 162 that is generally perpendicular to the mounting edge and that will typically be generally horizontally oriented and support an accessory there upon. A series of cooperating headed posts extend from the mounting edge. The headed posts extend into the circular portions of the accessory rail 124 key-hole slots 126 and slide downward into the key-hole leg or channel, where the head of the headed post holds against the key-hole leg and the bracket is releasably connected with the post by the mount, providing a releasable connection that is understood by one having ordinary skill in the art.

Figure 4:
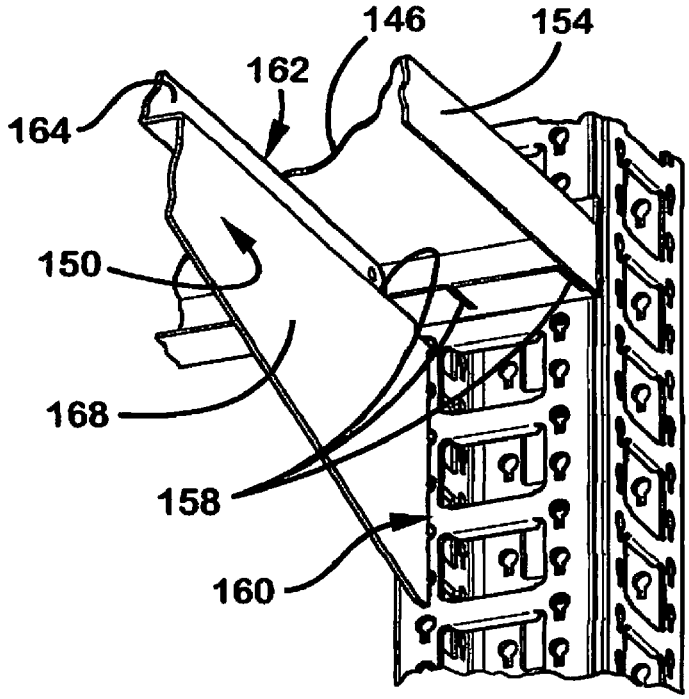
FIG. 4 is a lower end perspective view of an adjustable accessory support, showing an accessory shelf in a first alternative position with a first alternative support that engages a face of a supporting post.

The support edge 162 of the support bracket 150 has a tab 164 extending both generally upward and at least partially along the support edge. The bracket receptacles 158 of the shelf 146, or other accessory, are shown as a series of aligned cooperating slots as noted above. The bracket tab 164 is received in slip fit engagement into a preselected slot of the series of bracket receptacles 158. As shown in the drawing (FIG. 4), a J-channel may be formed along a back edge of the shelf 146 and the bracket receptacle slots may be formed in a leg of the J-channel. The front edge of the shelf may be a mirror image of the back edge.

Figure 7:
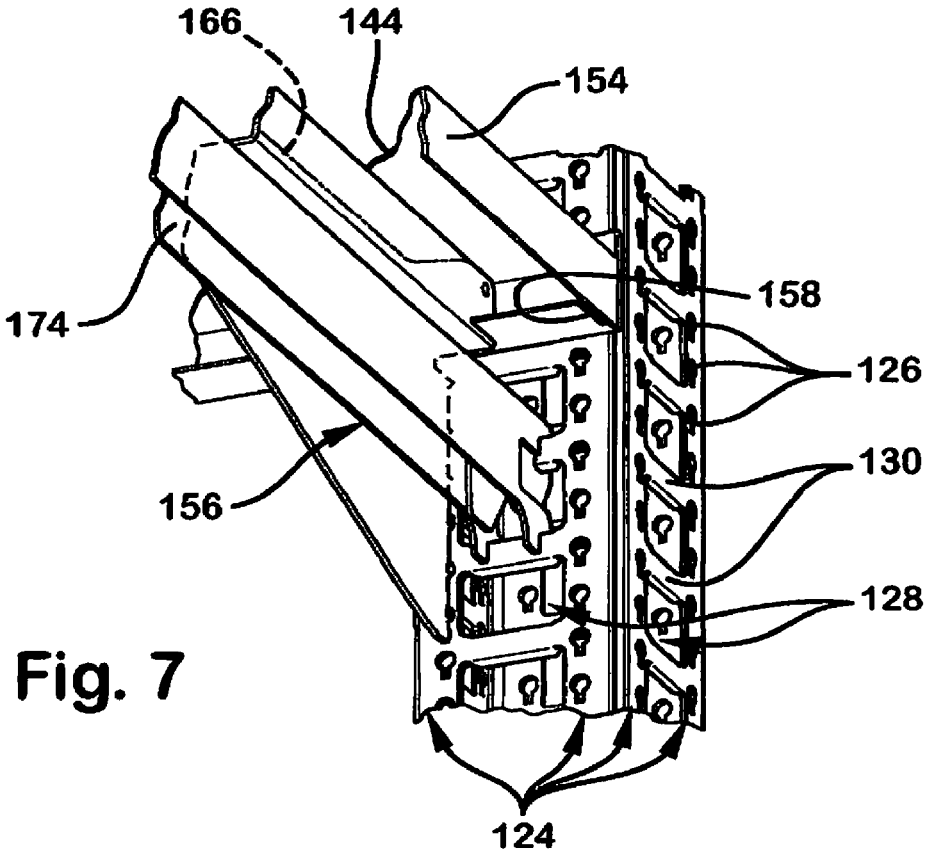
FIG. 7 is the view of FIG. 4 showing the accessory in the first alternative position with a second alternative, mirror image support and an adjacent beam.

In one alternative of the shelf and bracket interconnection, the tab may be a pair of tabs with a tab at the front and a tab at the back of the shelf, as indicated by phantom line 166 (FIG. 7). Those who practice the invention will develop other variations of the shelf and bracket interconnection that are within the concept of the invention. One such variation may include a shelf and bracket interconnection that resists a forward tipping of the shelf, for example.

Figure 5:
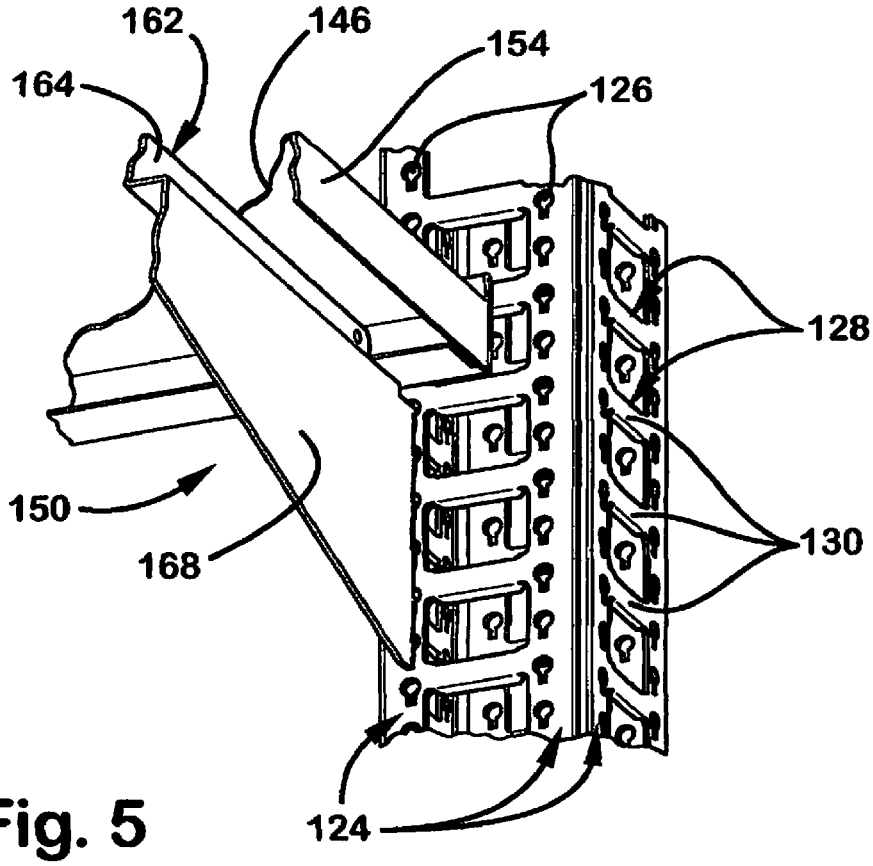
FIG. 5 is the view of FIG. 4 showing the accessory in a second alternative position.
Figure 6:
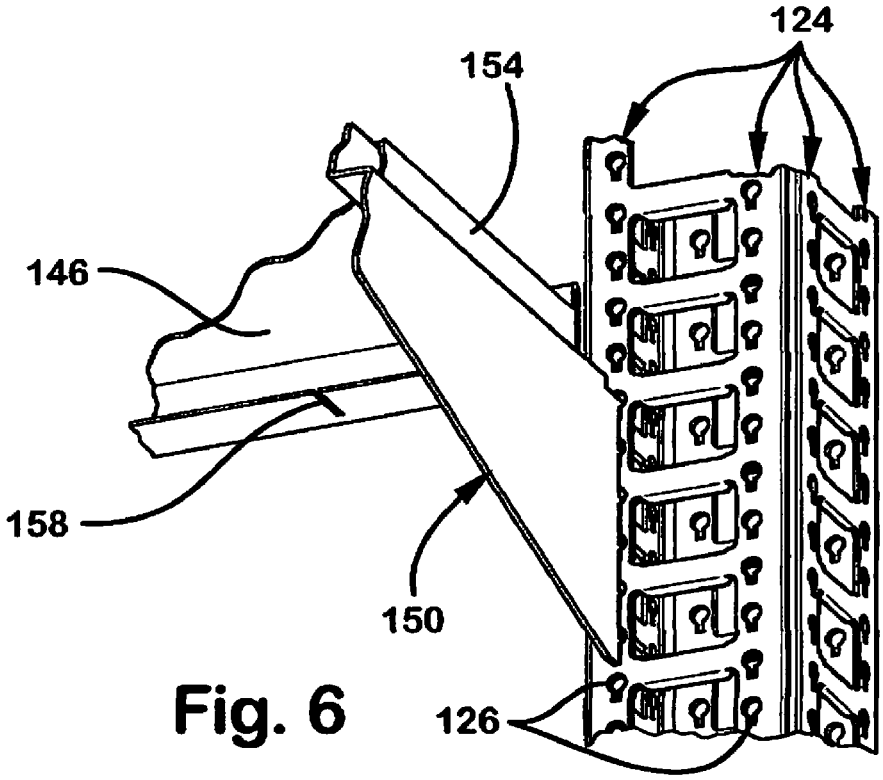
FIG. 6 is the view of FIG. 4 showing the accessory in a third alternative position.

As may now be understood from the disclosure of the shelf and post interconnection of the invention, an accessory may be positioned substantially as desired relative to supporting posts by a selection of available accessory receptacles 126 of one or the other rails 124 of the mount 120, and by a selection of available bracket receptacles 158 disposed along the length of the accessory. The drawing shows by example, that a shelf or other accessory end may be positioned generally flush with a post side (FIG. 4) and may also be positioned with progressive stepping to the left (FIGS. 5 & 6) as shown relative to a right end of the accessory. Of course, the left end of the accessory may simultaneously be positioned flush with a post side and also progressively stepped to the left and beyond the post, depending upon the accessory length relative to post spacing. Alternatively, the left end of the accessory may progressively step right with appropriate support bracket selection and placement as one having ordinary skill in the art will understand.

Figure 8:
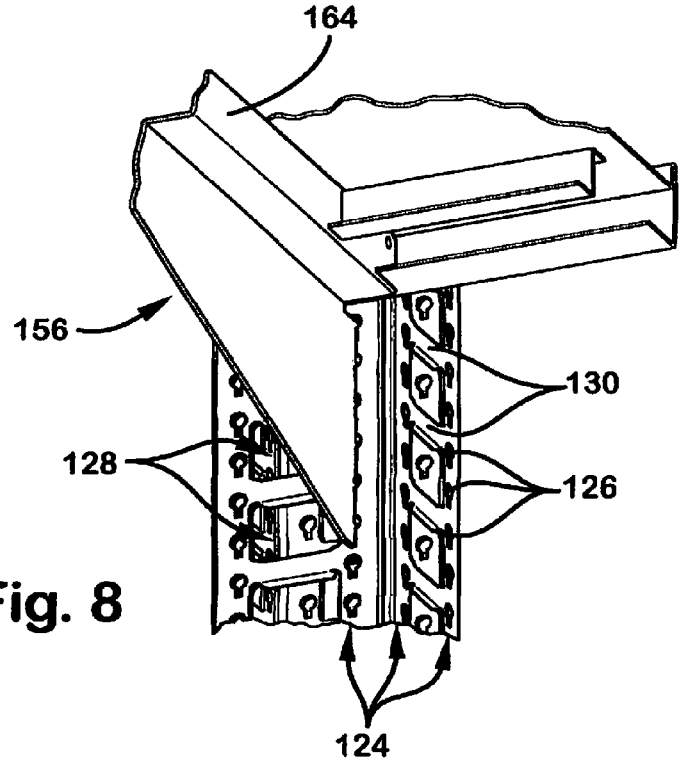
FIG. 8 is a lower perspective view of an opposite end of the accessory shelf of FIG. 4, showing a third alternative support that engages a side of a supporting post.

In consideration of this versatility of the placement of the storage accessory shelf 146, a mirror image support bracket 156 may be provided as seen in FIGS. 7 and 8. More specifically, the spacing of the three bracket receptacles 158 shown (FIGS. 4-6) is noted to provide stepping of the shelf in incremental steps that are about half a width of the supporting post 110, although another base or modular increment may also be chosen. Again in the example shown, the accessory receptacles 126 on the supporting post are noted to be located about half way between adjacent bracket receptacles 158, while the support bracket 150 support edge tab is offset to one side (FIG. 4) or the other (FIG. 7) from a body 168 (FIG. 4) of the support bracket about half the spacing of the bracket receptacles to align with one or another adjacent bracket receptacle 158. Those who practice the invention will develop configurations of the support bracket 150 that may be other than a generally triangular member, which is specifically shown in the drawing, without departing from the inventive concept of locating an accessory at various positions relative to a supporting post.

Figure 1:
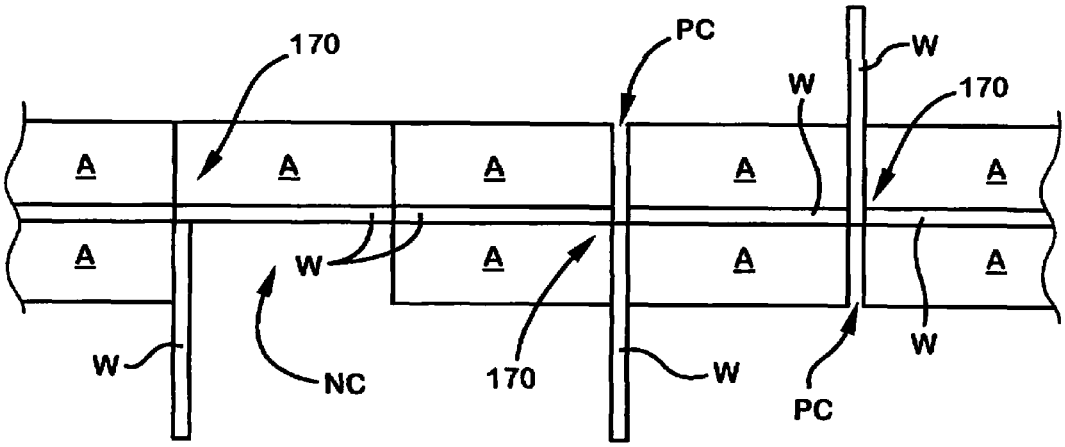
Fig. 1 (Prior Art)
FIG. 1 is a fragmentary top plan schematic view of a prior art modular wall, showing a wall creep issue.

The feature of locating an accessory at various positions relative to a supporting post is particularly beneficial when the posts of the post and beam construction are not uniformly spaced, which may typically occur with a terminal or end post of a line of posts or with a hub post in a "T" 170 (FIG. 1), an "X," or other intersection or corner of wall portions. Conversely, the posts may be set in uniform spacing and a foreshortened shelf may be used at such intersection points. Thus, the accessory and post interconnection of the invention provides selective positioning of the accessory, or at least an accessory end, relative to supporting posts. This is accommodated, even when the posts are not spaced apart according to the length of the accessory, but are spaced apart at one of various incremental distances, according to the spacing of both cooperating bracket receptacles 158 that are disposed along the accessory length and the spacing of accessory rail portions 124 or at least accessory receptacles 126 on supporting posts.

While accessories that are connected with mounts 120 of adjacent posts may serve as beams, which position, space, and interconnect adjacent posts as suggested above, separate beam members 174, 176 are more preferably used so the accessories may be freely arranged or rearranged without consideration of affecting foundational structure, namely, the posts and the beams which can be co-located on the same sides of the posts as the accessories without interfering with the accessories (FIG. 7). A beam 174, 176 of the post and beam furniture construction is typically an elongated member with a body 180 extending along a beam length from a first beam end 182 to an opposite second beam end 184 (FIG. 10).

Figure 9:
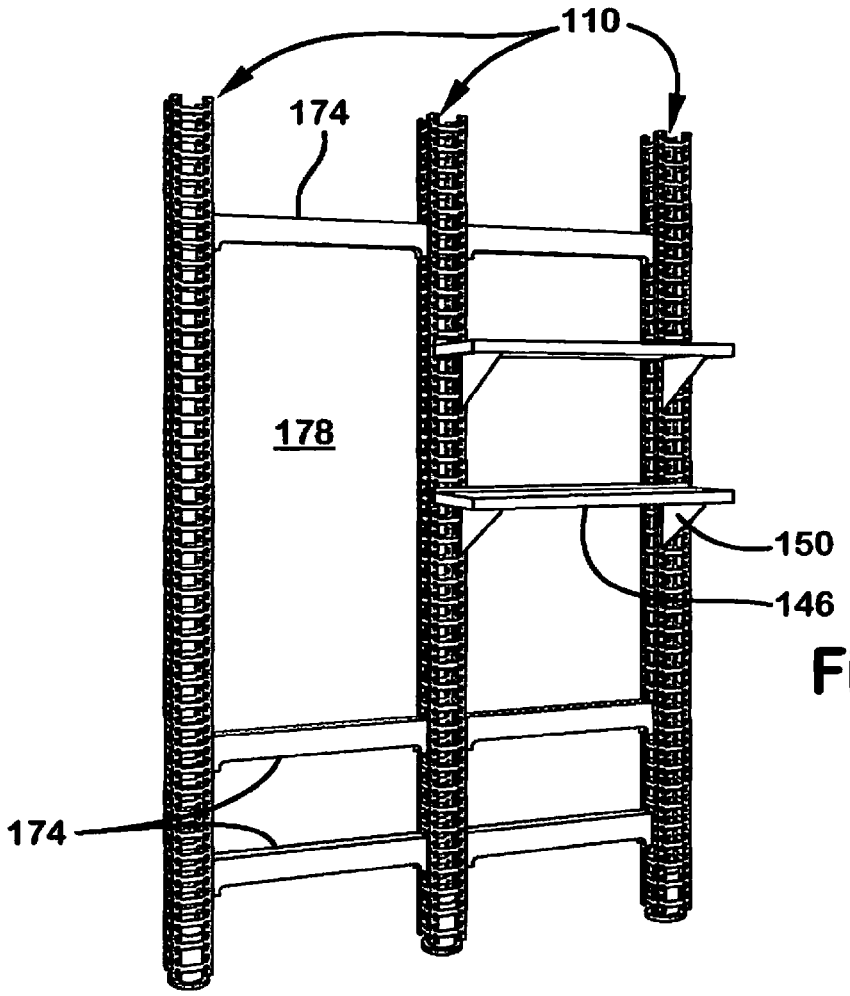
FIG. 9 is a perspective view of a third arrangement of a post and beam furniture construction of the invention, showing post and beam interconnection.
Figure 10:
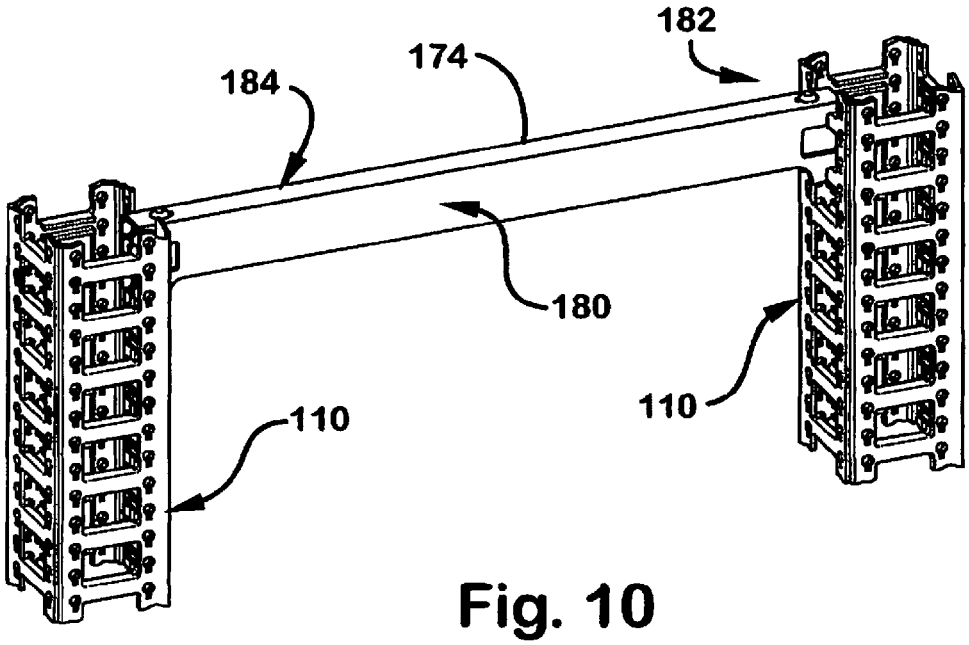
FIG. 10 is an enlarged detail of post and beam interconnection, with a fixed length beam.

The beams 174, 176 typically extend substantially horizontally between adjacent posts, with the first beam end 182 capturing a selected rung of a first mount and the second beam end 184 capturing a corresponding selected rung of a second mount that aligns with the rung of the first mount and positions the beam horizontally (FIG. 10). The beams may have a shallow depth as with beams 174 (FIGS. 7 and 9) or may have a deep depth as with beams 176 (FIG. 2). Minimal dimensions of a beam should be dictated by structural requirements. Beam dimensions may be subject to increase, if structural capacity is not compromised, for aesthetic considerations. The beams may also be used to place privacy screens 178 and other partitions or panels and the like (FIG. 9).

Figure 12:
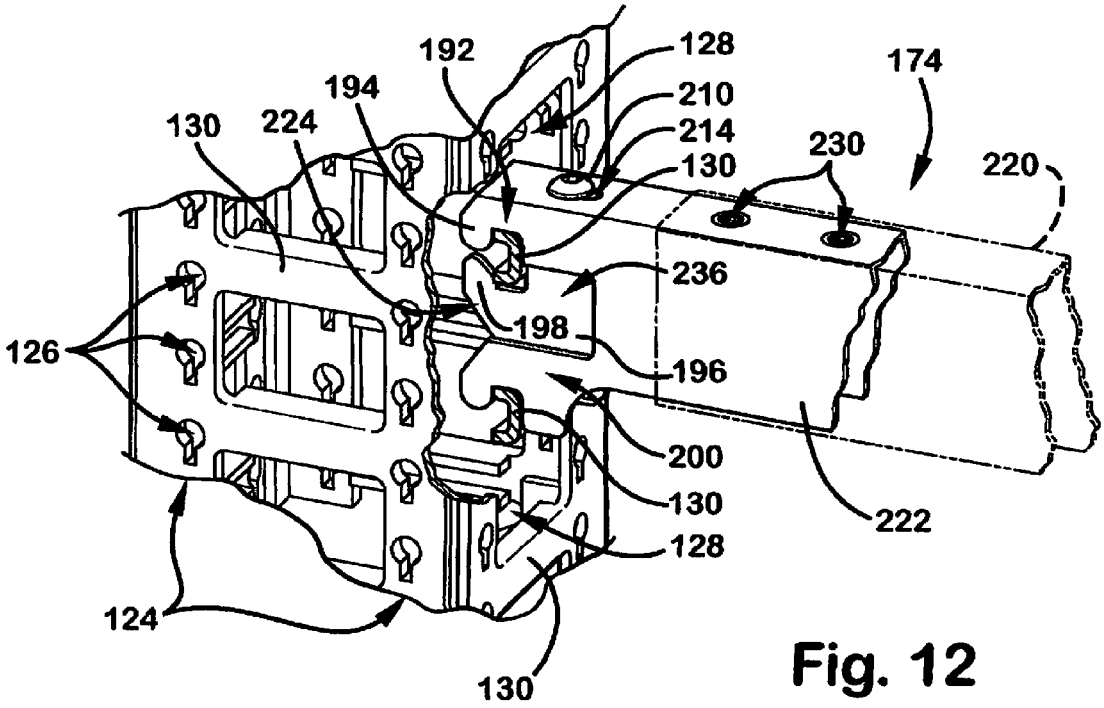
FIG. 12 is a fragmentary perspective view of a post, showing a beam jaw portion of an adjustable length beam connected with the post, and showing a beam body portion in phantom.
Figure 13:
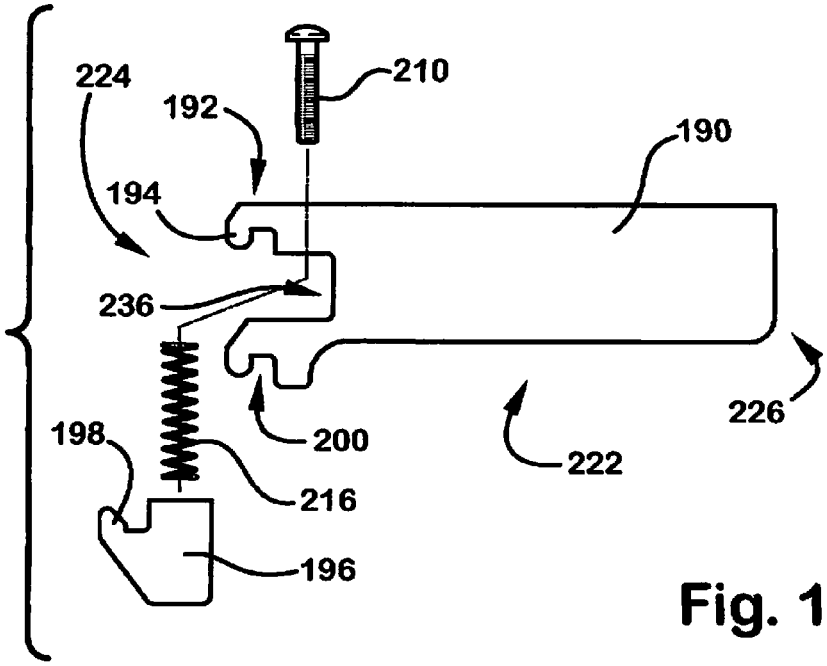
FIG. 13 is an exploded side elevation view of a beam jaw portion.
Figure 14:
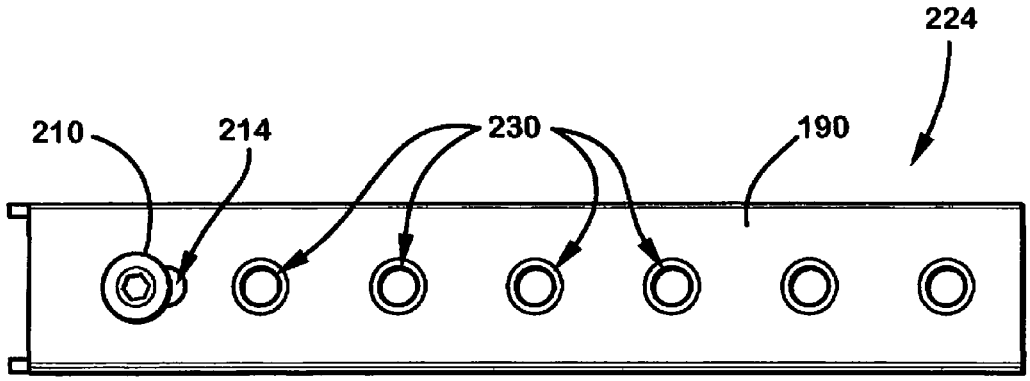
FIG. 14 is a top plan view of a body thereof.
Figure 15:
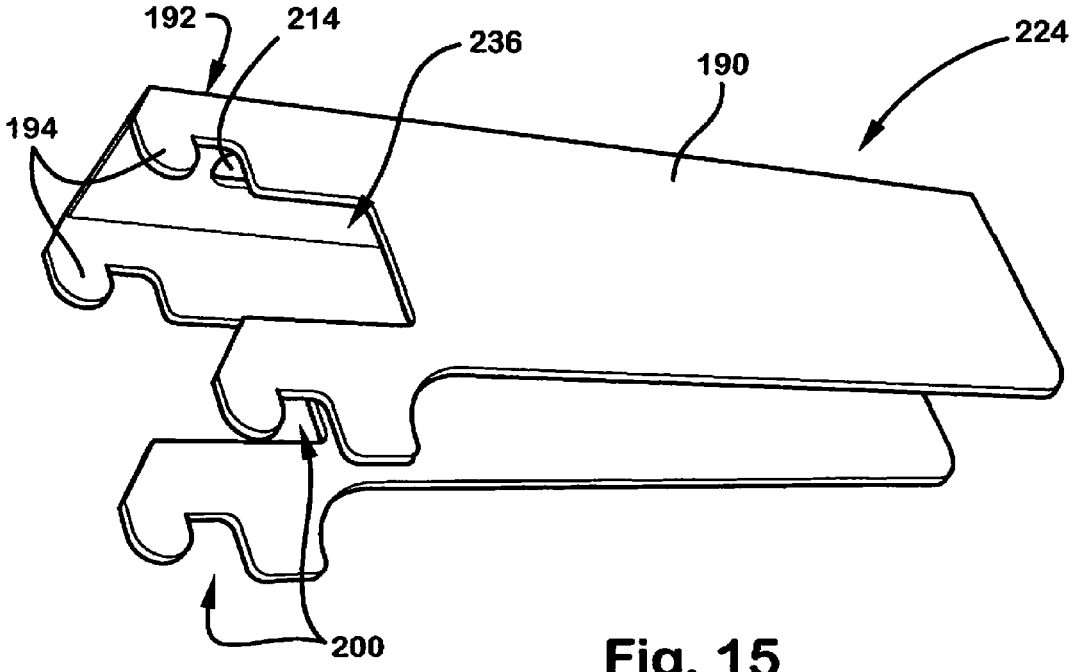
FIG. 15 is a bottom perspective view of a jaw end thereof.
Figure 16:
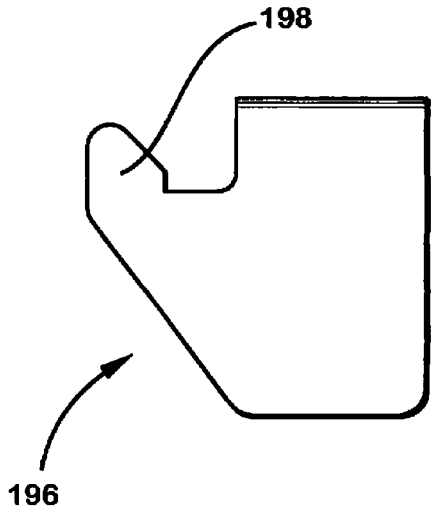
FIG. 16 is a side elevation view of a lower jaw of the jaw portion.
Figure 17:
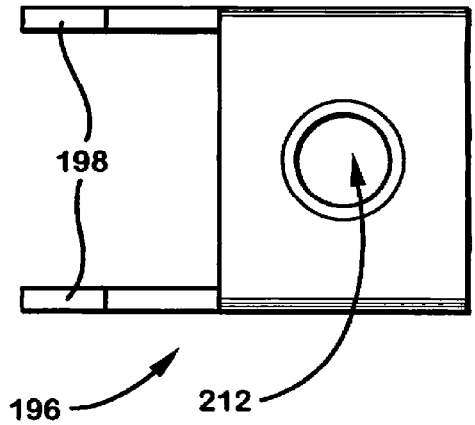
FIG. 17 is a top plan view thereof.

As is generally shown in the drawing, a beam 174 of a post and beam furniture construction of the invention may have a fixed length (FIGS. 9-11) or have an adjustable length FIG. 12. Each beam end has a jaw portion or end 224, discussed further below, that is configured to adapt the beam for coupling with a mount 120. The jaw portion may be an integral part of a fixed length beam or may be a separable end of an adjustable length beam, for example, as will be discussed further below. Either fixed or adjustable length, the jaw configuration is most preferably the same.

Figure 18:
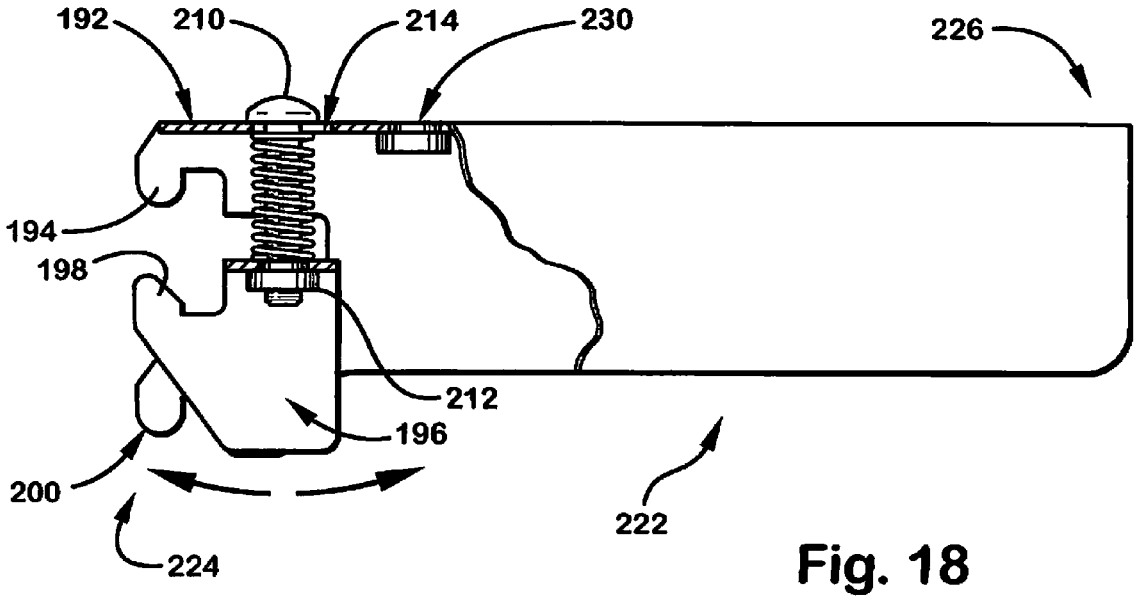
FIG. 18 is a partially fragmented side elevation of the jaw portion, showing the lower jaw in elevation and positioned in the jaw portion.
Figure 19:
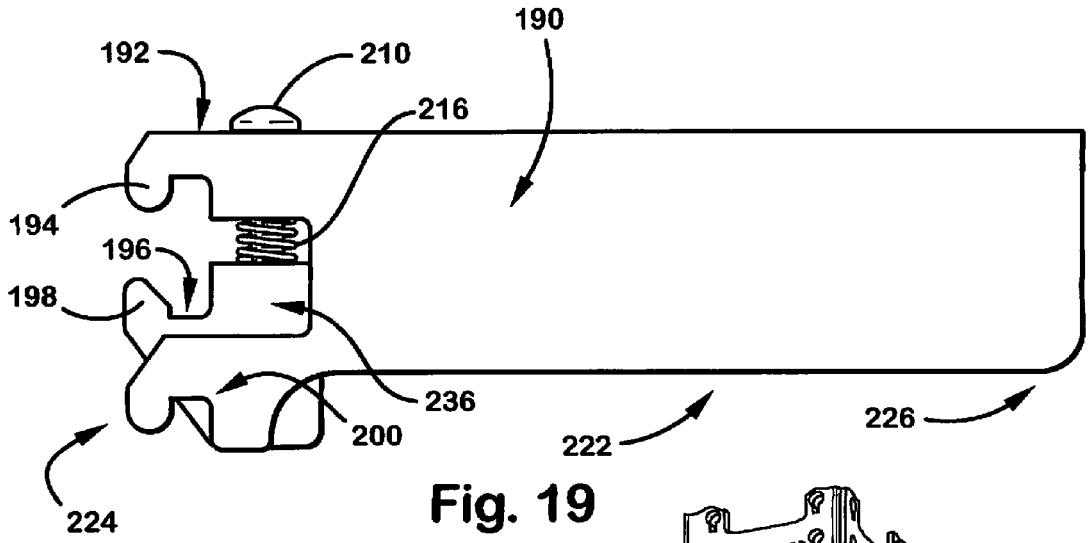
FIG. 19 is a full side elevation view of the jaw portion of FIG. 18.

With reference to FIGS. 11-19, each beam end, fixed or adjustable, has a jaw portion 224 with a body portion 190 with an upper jaw 192 and a downward extending tooth 194, which adapts each beam end to releasably capture a rung 130. The jaw portion 224 of the beam further preferably has a lower jaw 196 with an upward extending tooth 198 (FIG. 12) that cooperates with the upper jaw 192, so the rung 130 may be captured between the upper and lower jaws. One and preferably the lower 196 of the upper and lower jaws is movable between a closed position in which the lower jaw is aligned with the upper jaw and captures a rung between the upper and lower jaws (FIGS. 11 & 12), and an open position in which the lower jaw is spaced away from the upper jaw (FIGS. 18 & 19). A third jaw 200 (FIG. 12) is also preferred to resist post and beam racking.

In the preferred embodiment, the movable jaw 196 is connected with the jaw body 190 by a connection screw 210. Thus, the movable jaw is provided with a cooperating internally threaded hole 212 to engage the connection screw and the jaw body has a larger hole 214 for the connection screw to slip into and be seated in. Rotational actuation of the connection screw translates the movable jaw between the open and closed positions. The selection of the movable jaw having the threaded hole and the jaw body having the slip fit hole anticipates this as an arrangement of typical use, although circumstances of a specific use or installation of the invention may indicate that an opposite arrangement may be desired as one having ordinary skill in the art will understand.

Again, the jaw body 190 and generally the beam assembly are generally shown defined by an open sided channel with the open side facing downward; the upper jaw is fixed with a downward extending tooth; and the lower jaw is movable with an upward extending tooth. This is a preferred and typical arrangement or orientation, so the jaw portion of a beam may be set on selected rungs with the fixed jaw supporting the beam. With the beam resting on selected rungs, the movable jaw may be drawn up into the cooperating, clamping, closed position relative to the upper or fixed jaw by rotation of the connecting screw.

One having ordinary skill in the art will note that the movable jaw 196 capturing a rung 130 in the closed position (FIGS. 11 & 12) makes connection of the beam with the post relatively rigid and provides a safety feature of keeping the beam from being knocked-off or otherwise lifted from connection of the upper jaw with the rung. Further, a third jaw 200 is most preferably provided and more preferably provided on the jaw body 190, although it may alternatively be part of the opposing movable jaw member 196. The third jaw 200 is adapted to engage an adjacent rung 130 and provide lateral stiffening, or racking resistance, to the post and beam construction without requiring additional diagonal bracing.

While the above jaw portion orientation is a preferred and a typical orientation, an "inverted" orientation is also anticipated. More specifically with reference to FIG. 12, an adjustable length beam 174 is shown with an open sided channel beam body 220 indicated in phantom in the typical, anticipated orientation with the open side facing downward. An inverted orientation will have the beam body 220 inverted with the open side facing upward. The inverted orientation is advantageous, when a rigid panel member is desired to be supported by vertically adjacent beams, for example (FIG. 9). More specifically, a panel bottom edge may be set into and rest in an inverted beam body 220 that has the open side facing upward. An opposing panel top edge may be captured in another beam assembly that is oriented with the open side facing downward. A rigid panel is thereby conveniently captured and stabilized in the post and beam construction, between vertically adjacent beams.

Again, in one aspect of the invention as noted above, the jaw portion of the beam may be configured as a separable member or beam coupler 222 that has an elongated jaw body 190 with the jaw portion 224 at one end and an opposite tail end 226 (FIGS. 18-19). The jaw body cooperates with the beam body 220 and is slidable along the beam length in telescoping engagement, with the jaw end 224 facing away from the beam body 220 (FIGS. 12, 13, 18, & 19). This beam coupler 222 is provided with a series of beam fasteners 230, namely, a series of internally threaded holes as shown, whereby the beam length may be adjusted as necessary and the beam coupler 222 and beam body 220 may be fixed together at an effective predetermined beam length. A cooperating end of the beam body is, therefore, provided with a corresponding series of cooperating holes (not shown apart from the coupler), so a pair of holes on the beam end and a pair of holes of the coupler 230 may be aligned at a desired beam length and a pair of screws 232 are slip fit through the beam, engage the coupler threaded holes 230, and screw fasten together the coupler 222 and the beam body 220.

Having at least one end of a beam terminate with a separable beam coupler 222 of the invention provides several advantages in construction flexibility. Of course, providing a separable beam coupler at each beam end even further enhances construction flexibility. One such advantage is an ability to reposition or otherwise replace a beam without moving the respective posts, by merely disengaging a coupler from the beam body.

Another advantage with each beam end having a separable beam coupler, is an ability to use commonly available tubular or channel structural members to construct beams. While one may inventory a number of beam couplers 222 and may also inventory various beam bodies 220, and further use them in a given post and beam construction, the beam bodies are substantially fungible items that are easily modified or replaced in the field. The use of a separable coupler at each beam end frees the user to greater flexibility and creativity in a post and beam construction with the invention without burdening the manufacturer or other vendor with onerous inventory or a plethora of beam component items.

An example of installation flexibility in the field is the availability with the invention to choose a particular beam body, say a closed tube as opposed to an open channel for strength or perhaps for cable or other conduit shielding considerations adjacent to the opening in the posts, providing further access to and between the interior cavities of the posts. With regard to an inverted beam orientation, discussed above, use of separable beam couplers at each beam end provides an option that the couplers may be positioned and fastened to their respective posts in a non-inverted orientation with only the beam body then being inverted and connected with the couplers, discussed further above.

To emphasize, a beam is an extensible length member when separable beam couplers 222 are used. This relates to the issue of panel creep and the variable position accessories discussed above in which an accessory may be located at various positions along its length relative to supporting posts. Telescoping or extensible length beams and variable position accessories may individually or in combination advantageously absorb or displace panel or post creep.

In another aspect of the invention, a fixed length beam member may be installable between or removable from between a pair of supporting posts without repositioning the posts. This may be accomplished with a properly configured beam end by inserting the beam end into its respective post beyond an installed position, which positions the beam opposite end clear of its respective post. Thus, the beam opposite end is positioned clear from its respective post, which results in the beam being removable from or installable between its supporting posts without repositioning the posts.

A beam end configuration that accommodates this installation and removal is the jaw portion 224 including a cutaway portion 236 extending along the beam length or beam coupler length from the upper jaw 192 of one beam end toward the other beam end, so the beam end may slide past a rung 130, into the mount opening 128, and into the post. It is also noted that if the movable jaw were fixed longitudinally, then this situation may typically preclude extending the end of the beam into its respective post to free the opposite end of the beam for removal of the beam from or insertion of the beam between its support posts without moving the posts.

Thus, the lower jaw 196, or the movable jaw, is further preferably connected by way of a toggle connection, as shown (FIGS. 11-19) or the like, so the lower jaw may translate along the beam length 198 (FIG. 18). More specifically, the toggle connection of the movable, or the lower jaw 196, as shown is accomplished by way of the elongated bolt 210 extending through an oval hole 214 in the beam and the hole being an oval aperture with the major axis of the oval extending along the beam length. This geometry of the oval aperture accommodates a longitudinal swing of the bolt shaft while still providing lateral shoulders for the bolt head to rest on. Further, an extension spring 216 is preferably placed between the movable jaw 196 and the beam to keep the bolt extended through the beam aperture, rather than allowing the bolt to retract back through the aperture.

Figure 20:
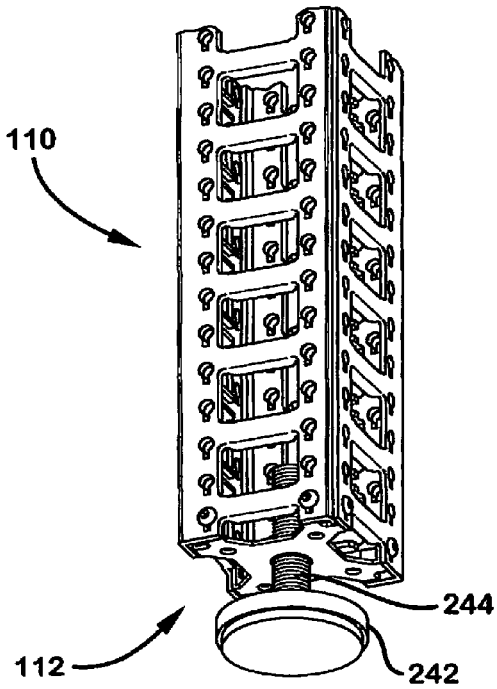
FIG. 20 is a fragmentary bottom perspective view of a floor end of a post, showing the post with a foot.
Figure 21:
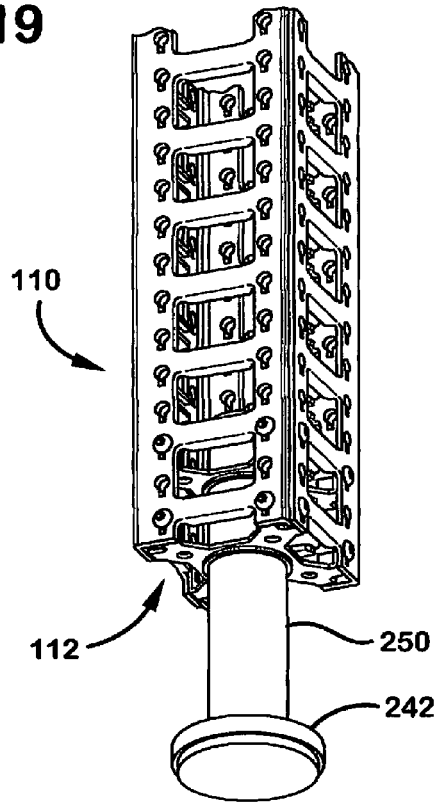
FIG. 21 is the view of FIG. 20, showing an alternative elongated foot.

Finally, a post may be provided with a foot at the floor end 112 (FIGS. 20 & 21). A fixed foot may be connected directly to the post floor end or an adjustable foot may be connected with the post floor end. An exemplary adjustable foot is shown with a foot pad 242 and a screw adjusting shaft 244 engaging a cooperating threaded opening in the post floor end. Alternatively, the pad 242 and optionally the shaft 244, may be located in a spaced relationship with the post floor end 112 by a foot base 250 that extends the foot pad from the post.

One having ordinary skill in the art and those who practice the invention will understand that various modifications and improvements may be made without departing from the disclosed inventive concept. Various relational terms, including left, right, front, back, top, and bottom, for example, are used in the detailed description of the invention and in the claims only to convey relative positioning of various elements of the claimed invention and are not otherwise used to limit the scope of the invention.

What is claimed is:

1. In a post and beam furniture construction with at least two posts that are elongated members extending generally upward from a floor end to an opposite terminal end and that have a length from the floor end to the terminal end, and with at least one beam interconnected between the two posts, an improved connection, comprising:

a mounting surface extending along the length of each post with the two posts comprising first and second posts and being spaced apart with their mounting surfaces facing one another, each mounting surface having two opposing edges that extend along the post length with a rail portion extending along each opposing edge and a plurality of openings disposed along the length between the rail portions, each of said plurality of openings being adapted to receive an end of a beam and each of said plurality of openings defining a rung portion between the rail portions, each rail portion having an array of accessory receptacles defined along the rail portion;

a beam having an elongated body with a length, with a first beam end, and with an opposite second beam end, each beam end having a jaw portion with an upper jaw comprising an upper and lower pair of downward extending teeth, the upper jaw being adapted to releasably capture a selected one of said rung portions therein, the upper jaw of the first beam end capturing a selected one of said rung portions of the first post, the upper jaw of the second beam end capturing a selected one of said rung portions of the second post that aligns with the selected rung portion of the first post, the first beam end jaw portion being a separable member having an elongated jaw body with a jaw end and an opposite tail end that slides along the beam length in telescoping engagement;

a fastener that secures the tail end of the jaw body to the body of the beam at a predetermined position relative to the beam length; and an accessory connected with one of the accessory receptacles of the first and second posts; one of the first and second beam end jaw portions has a lower jaw with a pair of upward extending teeth that cooperate with the upper jaw and captures the selected one of said rung portions; and wherein the lower pair of downward extending teeth, together with the pair of upward extending teeth, pass through a single one of the openings in the mounting surface of the first post.

2. The furniture construction of claim 1 wherein the lower jaw is moveable between a closed position in which the lower jaw is aligned with the upper jaw and captures one of said rung portions between the upper and lower jaws, and an open position in which the lower jaw is spaced away from the upper jaw and may translate along the beam length.

3. The furniture construction of claim 2 wherein the one of the first and the second beam end jaw portions may be inserted into the respective post and the other of the first and the second beam end jaw portions is thereby removable from the other post and the beam is removable from the two posts without repositioning the two posts.

4. The furniture construction of claim 3 wherein at least one of the posts further has an interior cavity extending along the length, wherein the openings define passages into the interior cavity, and wherein the interior cavity and openings define infrastructure passageways.

5. The furniture construction of claim 1 wherein one of the first and the second beam end jaw portions may be inserted into the respective post and whereby the other of the first and the second beam end jaw portions is removable from the other post and the beam is thereby removable from the two posts without repositioning the two posts.

6. The furniture construction of claim 1 wherein at least one of the posts further has an interior cavity extending along the length, wherein the openings define passages into the interior cavity, and wherein the interior cavity and openings define infrastructure passageways.

7. A post and beam furniture construction with at least two posts that are elongated members extending generally upward from a floor end to an opposite terminal end and that have a length from the floor end to the terminal end, and with at least one beam interconnected between the two posts, comprising:

a generally flat mounting surface extending along the length of each post, the posts comprising a first post and a second post, the first post being spaced from the second post with the mounting surfaces of the first and second post facing one another, each mounting surface having two opposing edges that extend along the post length with a rail portion extending along each opposing edge and a plurality of rungs extending between the rail portions and defining a plurality of openings disposed along the length, each opening being adapted to receive an end of a beam, each rail portion having an array of accessory receptacles defined along the post length; and a beam having an elongated body with a length, with a first beam end, and with an opposite second beam end, each beam end having a jaw portion with an upper jaw comprising an upper and lower pair of downward extending teeth, the upper jaw releasably capturing a selected one of said rungs therein, the first beam end capturing a selected one of said rungs of the mounting surface of the first post, the second beam end capturing a selected one of said rungs of the mounting surface of the second post that aligns with the selected rung of the first post, one of the jaw portions having a lower jaw with a pair of upward extending teeth that cooperates with the upper jaw and captures the selected one of said rungs, wherein the lower pair of downward extending teeth, together with the pair of upward extending teeth, pass through a single one of the openings in the mounting surface of the first post the lower jaw being moveable between a closed position in which the lower jaw is aligned with the upper jaw and captures the selected one of said rungs between the upper and lower jaws, and an open position in which the lower jaw is spaced away from the upper jaw and may translate along the beam length, the one of the jaw portions may be inserted into the respective post and the other of the jaw portions is thereby removable from the other post and the beam is removable from the two posts without repositioning the two posts.

8. The furniture construction of claim 7 wherein the first beam end jaw portion is a separable member having an elongated jaw body with a jaw end and an opposite tail end that slides along the beam length in telescoping engagement.

9. The furniture construction of claim 8 further including a fastener that secures the jaw body at a predetermined position relative to the beam length.

10. The furniture construction of claim 7 further including an accessory connected with one of the accessory receptacles of the first and second posts.

11. The furniture construction of claim 10 wherein the accessory is one of a group of accessories including a work surface, a storage accessory, and a lighting accessory.

12. The furniture construction of claim 7 wherein at least one of the posts further has an interior cavity extending along the length, wherein the openings define passages into the interior cavity corresponding to the width of the beam, and wherein the interior cavity and openings define infrastructure passageways with the beam.

* * * * *